US007614192B2

(12) United States Patent
Safie

(10) Patent No.: US 7,614,192 B2
(45) Date of Patent: Nov. 10, 2009

(54) BUILDING DRAINAGE SYSTEM

(76) Inventor: Steve A Safie, 29920 Maison, St. Clair Shores, MI (US) 48082

( * ) Notice: Subject to any disclaimer, the term of this patent is extended or adjusted under 35 U.S.C. 154(b) by 793 days.

(21) Appl. No.: 10/981,976

(22) Filed: Nov. 5, 2004

(65) Prior Publication Data

US 2006/0096186 A1 May 11, 2006

(51) Int. Cl.
*E04B 1/70* (2006.01)

(52) U.S. Cl. ..... 52/302.3; 52/302.1

(58) Field of Classification Search ..... 52/169.5, 52/302.1, 302.3; 405/43
See application file for complete search history.

(56) References Cited

U.S. PATENT DOCUMENTS

| | | | | |
|---|---|---|---|---|
| 4,136,500 | A | 1/1979 | DiFiore | |
| 4,265,064 | A | 5/1981 | Parezo | |
| 4,290,252 | A | 9/1981 | Demirel et al. | |
| 4,391,551 | A | 7/1983 | Belcher | |
| 4,534,143 | A | 8/1985 | Goines et al. | |
| 4,553,561 | A * | 11/1985 | Morris | 137/362 |
| 4,612,742 | A | 9/1986 | Bevilacqua | |
| 4,745,716 | A | 5/1988 | Kuypers | |
| 4,848,380 | A | 7/1989 | Francis et al. | |
| 4,865,069 | A * | 9/1989 | Lacey | 137/132 |
| 4,878,781 | A | 11/1989 | Gregory et al. | |
| 4,930,272 | A | 6/1990 | Bevilacqua | |
| 4,981,150 | A | 1/1991 | Francis et al. | |
| 5,080,004 | A | 1/1992 | Francis et al. | |
| 5,248,218 | A * | 9/1993 | Belcher | 405/43 |
| 5,444,950 | A | 8/1995 | Kelly et al. | |
| 5,501,044 | A | 3/1996 | Janesky | |
| 5,727,901 | A | 3/1998 | Rennie et al. | |
| 5,784,838 | A | 7/1998 | Phillips | |
| 5,836,115 | A | 11/1998 | Clay et al. | |
| 5,845,456 | A | 12/1998 | Read | |
| 5,852,906 | A | 12/1998 | Kuban | |
| 5,870,865 | A | 2/1999 | Wesolowski et al. | |
| 5,931,603 | A | 8/1999 | Swain et al. | |
| 6,230,468 | B1 | 5/2001 | Klaus | |
| 6,517,284 | B2 | 2/2003 | Gamache | |
| 6,550,190 | B2 | 4/2003 | Ruiz et al. | |
| 6,598,360 | B1 | 7/2003 | Pratt | |
| 6,634,144 | B1 | 10/2003 | Moore et al. | |
| 6,712,553 | B1 | 3/2004 | Niedermeyer | |
| 2002/0170246 | A1 | 11/2002 | Keller | |
| 2003/0059258 | A1 | 3/2003 | Lee et al. | |

* cited by examiner

*Primary Examiner*—Basil Katcheves
(74) *Attorney, Agent, or Firm*—Young, Basile, Hanlon & MacFarlane

(57) ABSTRACT

A building drainage system includes one or more of an interior located bleeder line cleanout incorporating a one-way flow valve, an exterior drainage and tile cleanout having concentrically disposed pipes with an end accessible from ground surface level, having apertures allowing the ingress of water through the pipes and to the drain tile system, and an exterior drainage system including a horizontal drain member located below soil surface level and spaced from the building foundation wall and a drainage path from the horizontal drain member to a reservoir also located below soil surface level. A discharge path is formed from the reservoir to the surrounding soil or through a pipe to a remote located pop-up discharge valve.

13 Claims, 5 Drawing Sheets

BUILDING DRAINAGE SYSTEM

BACKGROUND

The present invention relates, in general, to building drainage systems.

Conventional buildings typically have footings on which basement or foundation walls are built. Subterranean porous drain tiles are disposed about the outer perimeter of the footings. The drain tiles are typically in the form of perforated pipes which permit the ingress of water from the surrounding soil. Typically, the drain tiles are disposed in a gravel bed to improve their ability to accumulate water from the surrounding area without clogging.

The drain tiles or pipes are generally in fluid communication with a series of interconnected pipes disposed underneath the basement floor. The interconnected pipes or so-called "bleeders" are interconnected to a discharge pipe which is connected to the storm or sanitary sewer.

Buildings are also provided with an interconnected series of sanitary pipes or lines running from the building toilets and sinks. Typically, such sanitary lines have cleanouts in the form of removable caps located at convenient locations to enable the line to be cleaned if it becomes clogged.

To minimize the amount of water which can seep into the drain tiles, exterior drainage systems have been employed. In addition to sloping or grading the soil away from the building foundation walls, drains have been placed just below soil grade level and connected to the storm or sewer system for draining surface water away from the building before it can seep into the drain tiles.

It is believed that improvements to building drainage systems are still desirable.

SUMMARY

The present invention is an improved building drainage system incorporating many unique features. In one aspect, an interior cleanout apparatus is provided in the form of a hollow body fluidically interconnected to one bleeder line below a foundation floor. The body has an upper portion accessible form the building floor. A one way valve means is disposed within the body for allowing fluid flow through the body in one direction and for blocking fluid flow injected through an upper portion of the body in a direction opposite from the allowed fluid flow direction through the body.

In another aspect, an exterior cleanout apparatus includes a vertically extending interior conduit having a first end fluidically coupled to a building drain tile system and a second end accessible from above soil grade level. The interior conduit has apertures allowing the ingress of water to the interior thereof. An exterior is concentrically disposed about and spaced from the interior conduit. The space between the interior and exterior conduits is filled with a particulate material. The exterior cleanout allows a pressurized fluid stream to be injected into the drain tile system to remove clogs that may be present in the drain tile system. At that same time, the exterior cleanout provides a drainage path to relieve hydrostatic pressure in the surrounding soil by collecting water from the surrounding soil and directing it to the drain tile system.

In yet another aspect, a first generally horizontally extending drainage member is located below soil grade level and spaced from a foundation wall. The first drainage member is porous allowing the ingress of water into the interior thereof. The second drainage member is fluidically coupled to the first drainage member and extends to a reservoir means located below soil grade level. Means are provided for discharging water collected in the reservoir in the reservoir means. In one aspect, the discharge means includes a plurality of apertures formed in the container walls formed in the walls of the reservoir means allowing water to dissipate exteriorly of the reservoir means. In another aspect, another drainage member extends from the reservoir means to discharge water into the surrounding soil. The auxiliary drainage member may have a pop up discharge means coupled to one end while water will be discharged at the soil grade level.

The various features of the building drainage system according to the present invention, which features may be used separately or in any combination, provides an improved drainage system for controlling surface water and soil water by collecting and directing the collected water easily and efficiently to the surrounding soil or municipal sewer line. At the same time, the building drainage system has easy accessibility through cleanouts to the interior bleeder line below the foundation floor and to the exterior drain tiles to simplify the removal of any clogs which may be present in the bleeder lines or drain tile system.

BRIEF DESCRIPTION OF THE DRAWINGS

The various features, advantages, and other uses of the present invention will become more apparent by referring to the following detailed description and drawing in which.

DETAILED DESCRIPTION

Figure 1:
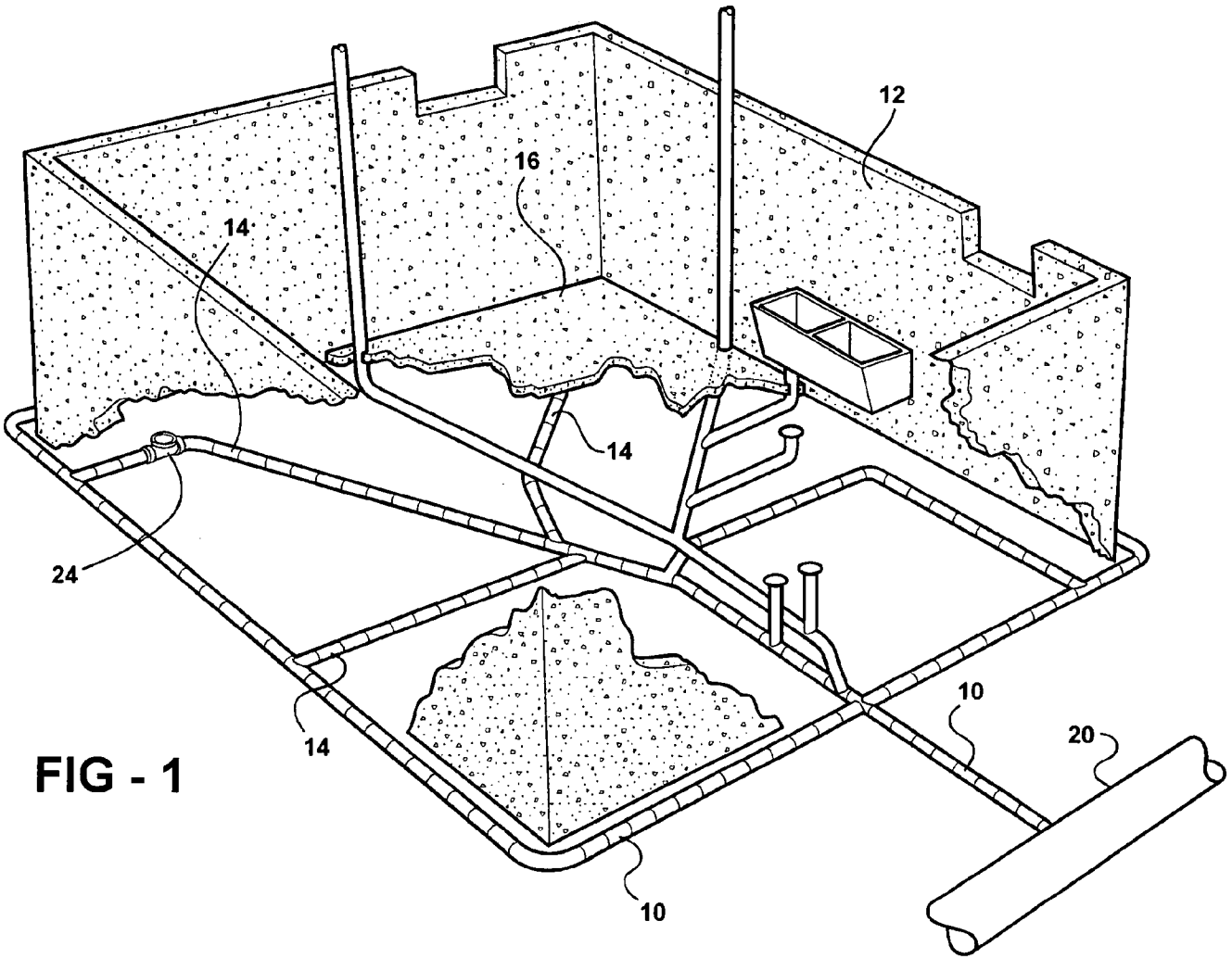
FIG. 1 is a perspective view of a building foundation bleeder system incorporating a cleanout.
Figure 2:
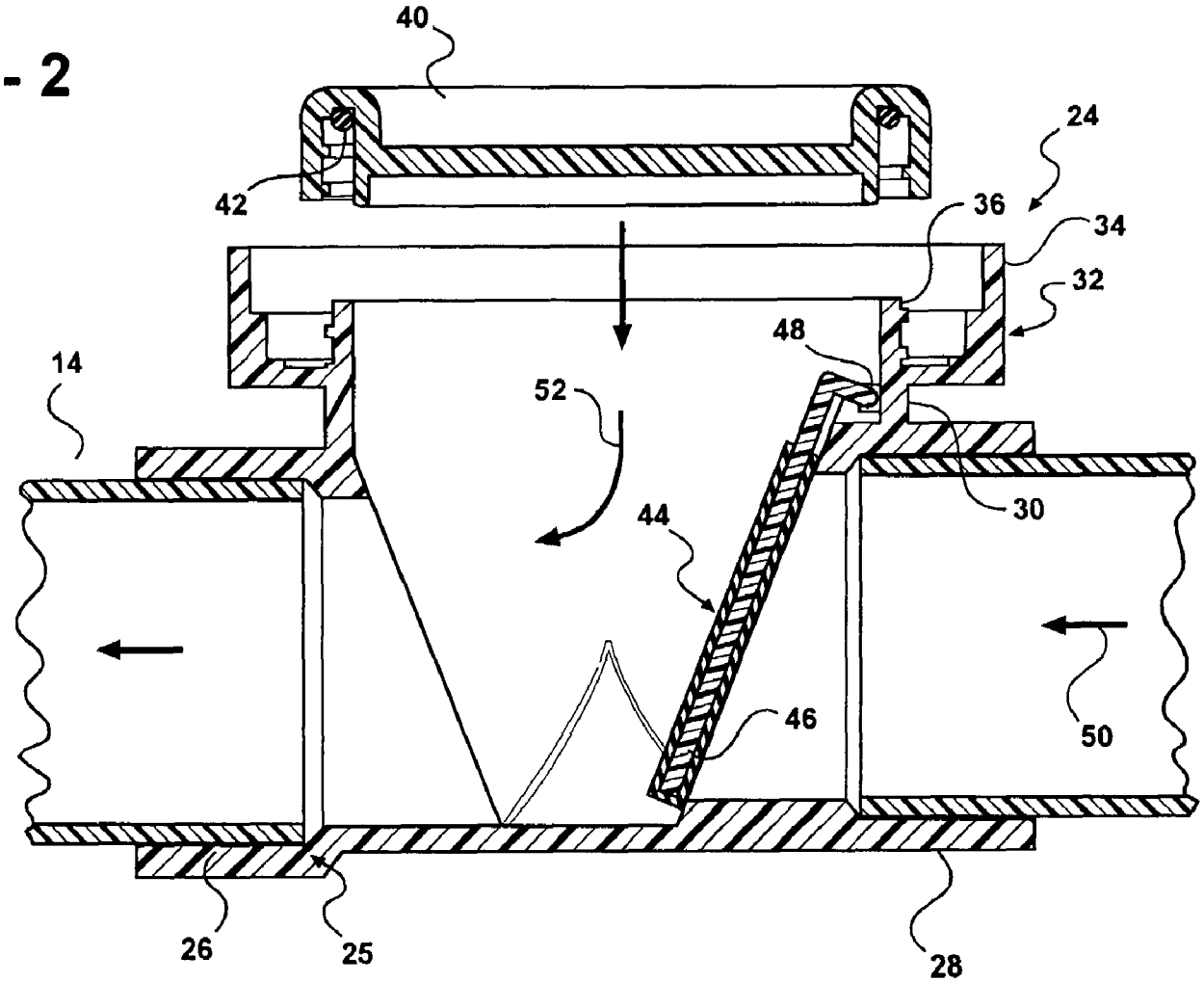
FIG. 2 is an enlarged, cross-sectional view of the cleanout shown in FIG. 1.

Referring to FIGS. 1 and 2, there is depicted one aspect of a building drainage system. The building drainage system includes the drain tile system of interconnected pipes 10 which are located exteriorly of the basement or foundation footings under the walls 12 and one or more interconnected pipes or bleeder lines 14 which are located beneath the basement floor 16 and interconnect the drain tiles 10 to a discharge pipe 18 which is connected to the municipal storm or sewer system 20. The bleeder lines 14 may also be connected to a sump pump, not shown, mounted in a basin formed beneath the basement floor 16.

A unique cleanout means 24 is provided for one or more of the bleeder lines 14. It will be understood that although only a single cleanout means 24, as shown in FIG. 1, multiple cleanout means 24 may be provided on one or more or even all of the bleeder lines 14 located beneath a basement floor 16. Each cleanout means 24 is preferably located near an exterior basement or foundation wall 12.

As shown in FIG. 2, the cleanout means 24 is fluidically coupled in a bleeder line or pipe 14. The cleanout means 24 includes a T-shaped body 25 having a generally axially extending portion formed of first and second, coaxial ends 26 and 28 and a central portion 30 extending angularly, such as perpendicularly, from the co-axial first and second ends 26 and 28.

The first and second ends 26 and 28 are fluidically and sealingly coupled into the bleeder line 14 by known means, including adhesive in the case of PVC pipe, etc. An enlarged collar 32 extends from the central portion 30 and has an outer wall 34 which is spaced from an inner wall 36. The outer and inner walls 34 and 36 are configured for removably receiving a cap 40 which may be threaded onto the inner wall 36. A seal 42 is carried in the cap 40 for sealing the cap 40 to the collar 32. Removal of the cap 40 allows access to the interior of the cleanout means 24.

By way of example only, the cleanout means 24 may be a backwater valve sold under the trademark PLUMBEST by John Stephens Corp. The cleanout means 24 includes an interiorly disposed valve 44 in the form of a flap member 46 which is pivotally connected at a pivot point 48 to the body 25. The flap member 46 may include a peripheral seal which sealingly closes an opening in the body 25 when the flap member 46 is in the closed position shown in FIG. 2. However, water flow in the direction of arrow 50 from the exterior drain tile 10 forces the flap member 46 away from the closed position to an open position allowing the water from the exterior drain tile 10 to flow past the flap member 46 and through the body 25 to the remainder of the bleeder line 14 in the direction of the municipal sewer line.

After the cap 40 has been removed from the body 25, a high pressure stream of air or water to be injected in the direction of arrow 52 through the body 25 and the downstream bleeder line 14 in the direction of the sewer 20 to cleanout the bleeder line 14. Backflow to the drain tile system 10 is prevented by the valve 44.

Figure 3:
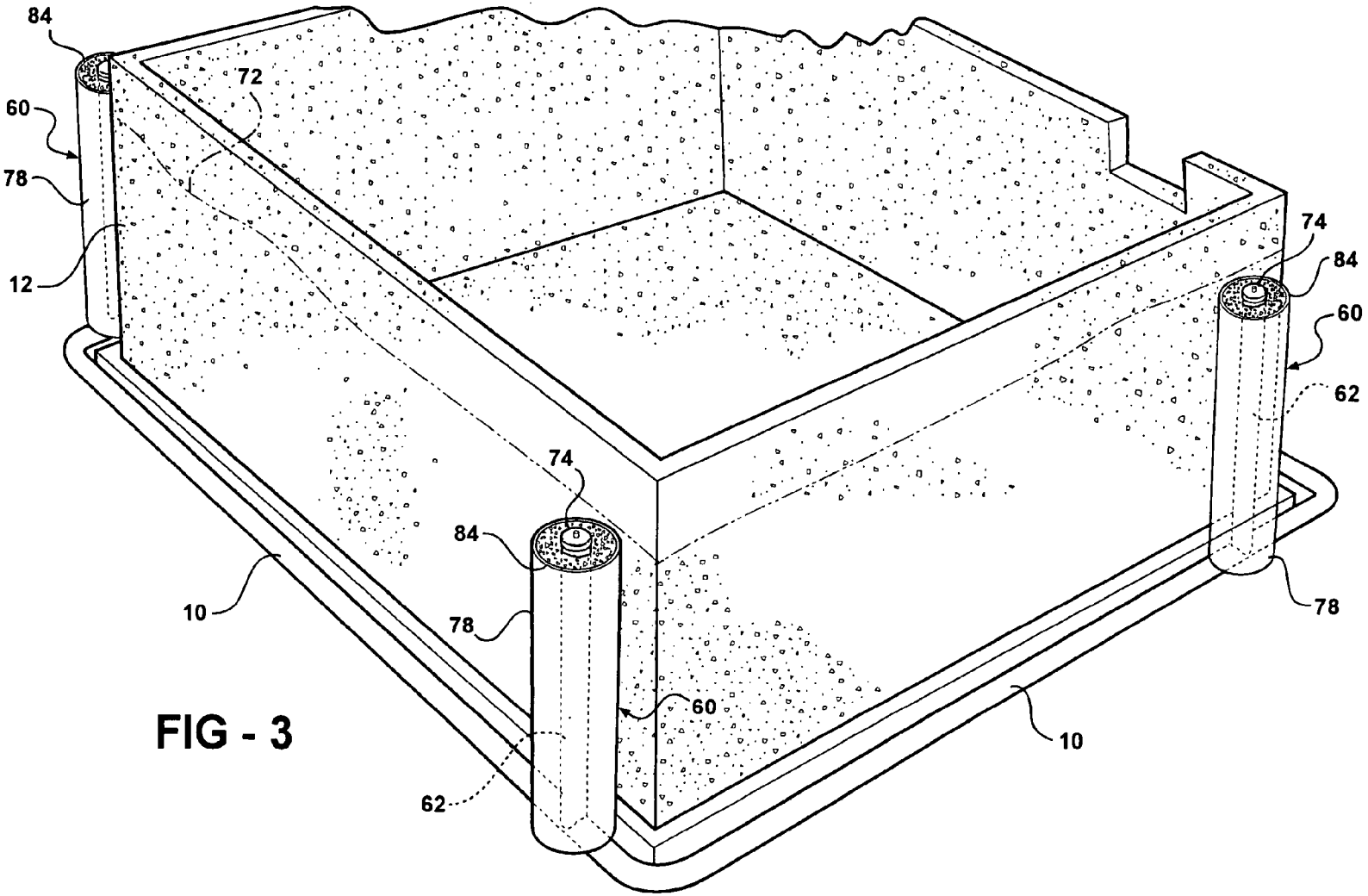
FIG. 3 is a perspective view of an exterior drainage and cleanout apertures in a building drainage system.
Figure 4:
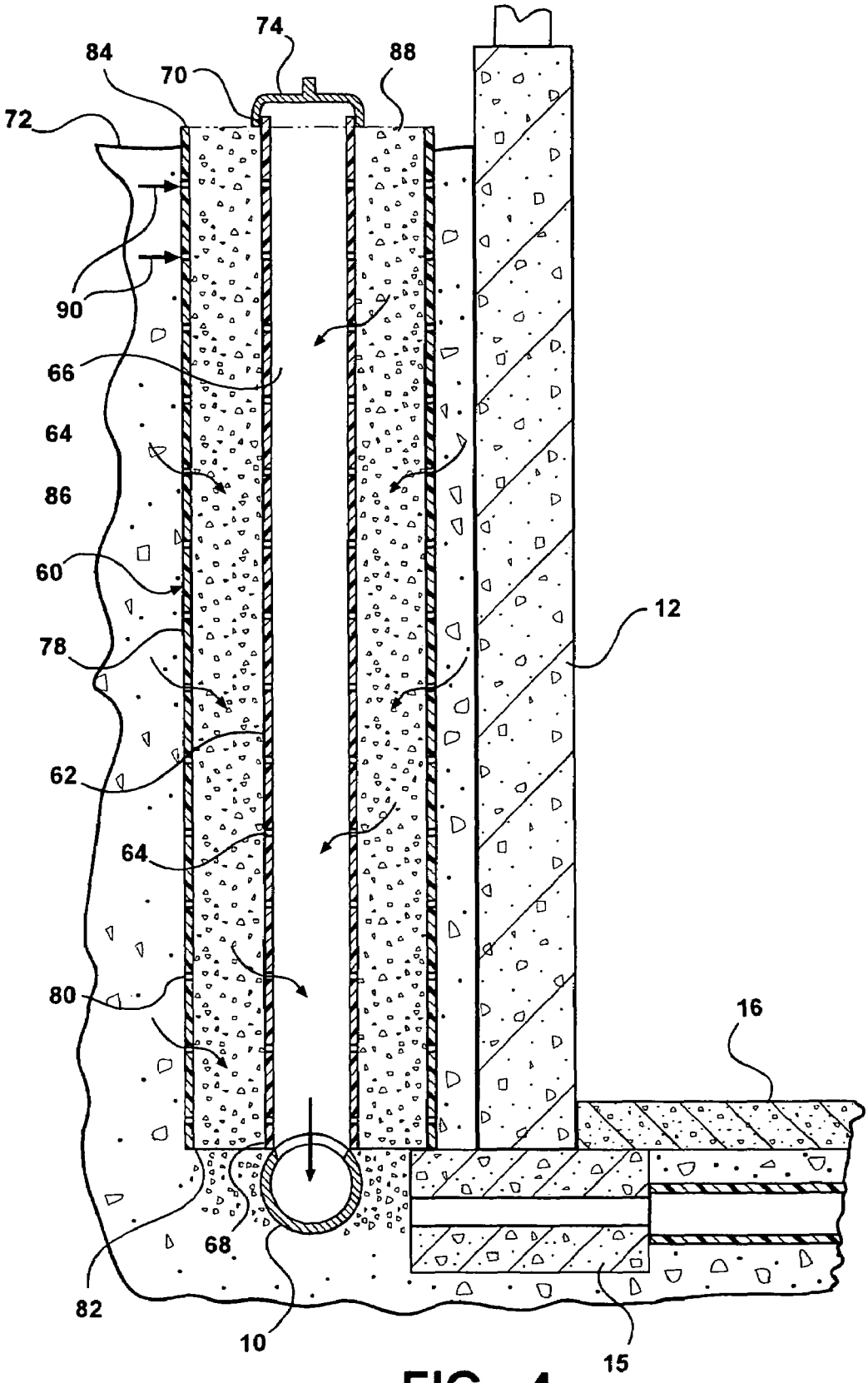
FIG. 4 is a longitudinal cross-sectional view of one of the drainage and cleanout apparatus shown in FIG. 3.

Referring now to FIGS. 3 and 4, there is depicted an exterior cleanout 60 for use in a building drainage system. The exterior cleanout means 60 may be used by itself in connection with the building drain tile system 10 or in combination with the interior bleeder line cleanout means 24.

The exterior cleanout 60 is provided at one or more locations around the periphery of the building foundation, such as at each corner, for example, of the foundation walls 12 as shown in FIG. 3. An exterior cleanout 60 may be placed at predetermined spaced locations, such as every five or ten feet, along the foundation walls 12 depending upon soil and ground water conditions, etc.

Each exterior cleanout 60 includes an interior riser or pipe 62 which can be formed of suitable materials, such as PVC. The interior pipe 62 includes a plurality of apertures 64 which allow the ingress of water in the direction of arrow 66 into the interior of typically vertically extending pipe 62. A lower end 68 of the pipe 62 is fluidically coupled to the foundation drain tile 10.

An upper end 70 of the interior pipe 62, which is typically located just above soil grade level 72, includes a cap 74 which can be removably attached to the upper end 70 of the pipe 62 by threads, a hinged connection, etc. The cap 74 and the mating upper end 70 of the pipe 62 may be provided with a sealed configuration, such as the seal shown in the cap of the valve body 25.

An exterior conduit or pipe 78, also including a plurality of perforations or small openings 80, is concentrically disposed about and spaced from the interior pipe 62 as shown in FIGS. 3 and 4. The exterior pipe 78 may also be formed of corrosion resistant materials such as, for example, PVC.

By example only, the interior pipe 62 may be a four inch diameter PVC pipe and the exterior pipe 78 may be an eight inch diameter PVC pipe.

The exterior pipe 78 has a lower end 82 adjacent to, but spaced from the lower end 68 of the interior pipe 62 and an upper end 84 generally coplanar with the upper end 70 of the interior pipe 62. The upper end 84 of the exterior pipe 78 may be left open. Particulate material 88, such as finely divided or gravel, 6 A stone fills the space between the interior and exterior pipe 62 and 78. The particulate material 88 allows water to flow in the direction of arrow 90 through the apertures 80 in the exterior pipe 78 into and through the apertures 64 in the interior pipe 62 and by gravity into the drain tile system 10 where it is directed away from the building foundation and footings.

The exterior cleanout 60 provides several functions. First, the exterior cleanout 60 provides hydrostatic pressure relief by providing a path for water away from the foundation wall 12 to the drain tile system 10. At the same time, the cap 74 may be removed from the interior pipe 62 and a high pressure stream of air or water directed through the interior pipe 62 and into the drain tile system 10 to clean out any clogs that may be present in the drain tile system 10.

Figure 5:
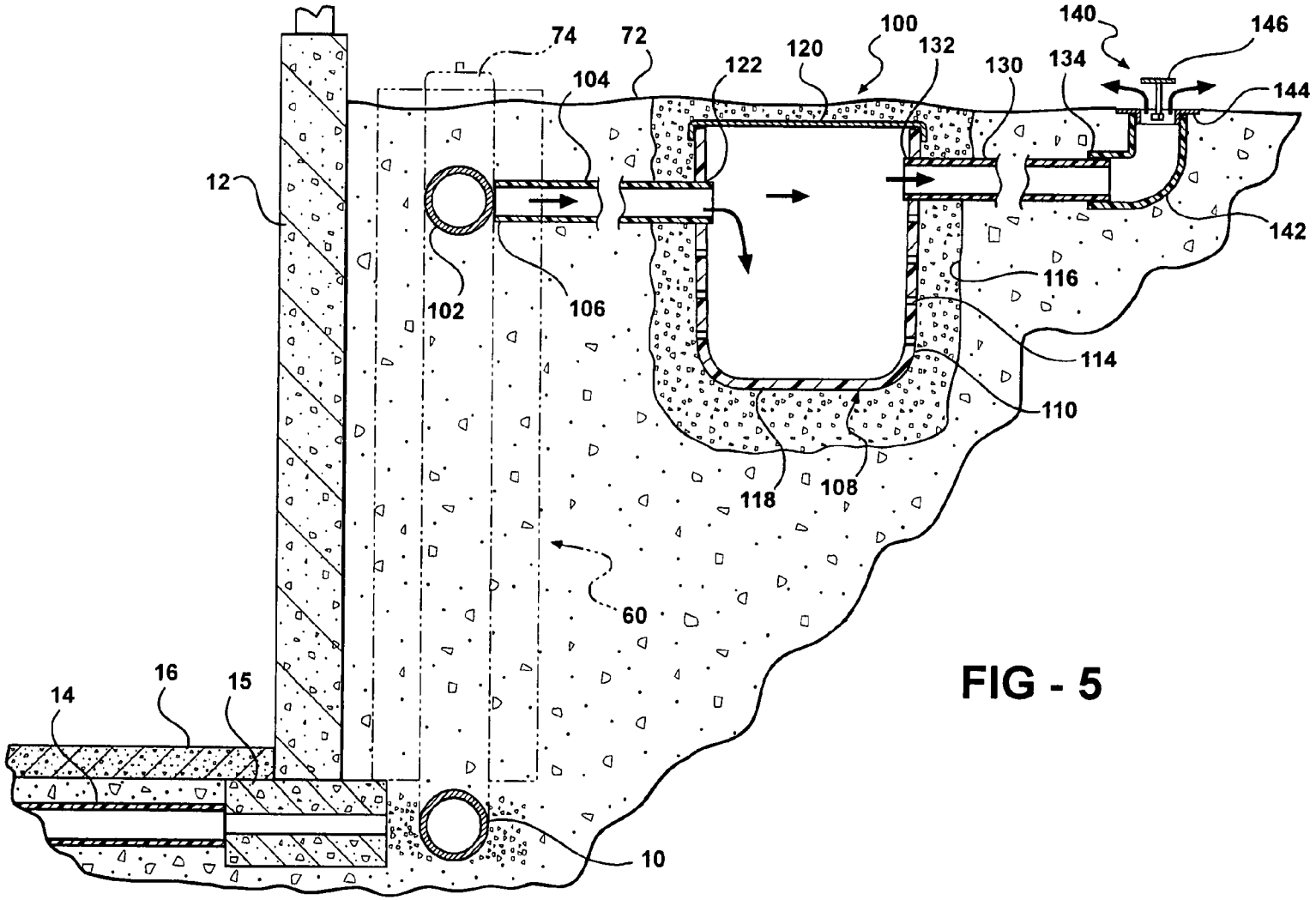
FIG. 5 is a cross-sectional view of another feature of a building drainage system.

Referring now to FIG. 5, there is disclosed an exterior drainage and reservoir means 100 which directs surface water away from the foundation walls 12 and provides a temporary storage of the drainage water prior to dissipation into the ground remote from the foundation walls 12.

It will be understood that the exterior drainage and reservoir means 100 may be employed by itself or with either or both of the interior bleeder line cleanout means 24 and the exterior cleanout means 60.

As shown in FIG. 5, a pipe 102 is located in a generally horizontal position just between grade level 72. The pipe 102 is spaced a short distance from the foundation walls 12. By example only, the pipe 102 is formed of perforated PVC pipe which allows surface water to flow into the interior of the pipe.

Although only a single pipe 102 is shown in FIG. 5, it will be understood that multiple drain pipes 102 may be installed around the entire foundation walls 12 and interconnected into a single elongated drain conduit.

A drain pipe 104 is connected at a first end 106 to the pipe 102 and directs water flowing into the pipe 102 from the pipe 102 to a reservoir 108. The reservoir 108 includes a tank or receptacle 110 located below surface grade level 72. While the tank 110 may be a completely closed container, improved water drainage may be achieved by providing the walls of the tank 110 with a plurality of small diameter apertures 114 which allow any water which is collected in the tank 110 to flow through the walls and be dissipated into the surrounding ground. The tank 110 is situated in a larger cavity or hole 116 formed in the ground below the surface grade level 72. The bottom of the hole 116 is filled with a finely divided particulate, such as gravel or 6 A stone. The tank 110 is then placed in the bottom layer of particulate 118 and the space between the sides of the tank 110 and the sides of the hole 116 are filled with the finely divided particulate 118. A removable cover 120 may be provided on the tank 110 for cleanout purposes.

As shown in FIG. 5, a second end 122 of the drain pipe 104 is fluidically coupled to the tank 110 allowing water collected by the horizontal pipe 102 to flow into and be temporarily stored in the tank 110. In normal conditions, the collection of surface water from sprinkler systems and light rain will be collected in the tank 110 and dissipated through the apertures 114 into the surrounding soil away from the foundation walls 12. This reduces the water load on the drain tile system 110.

In the event of excess water conditions, such as a heavy rain, water may collect in the tank 110 faster than it can be dissipated through the apertures 114 due to excess amounts of incoming water or a saturated surrounding soil. In this case, a secondary drain pipe 130 is connected at one end 132 to the container 110 above the location of the second end 122 of the drain pipe 104 in one side wall of the tank 110.

The secondary drain pipe 130 has a second end 134 which may be mounted below the surface grade level 72 to dissipate water from the top of the tank 110 into the surrounding soil. By example only, a pop up drain means 140 is coupled to the second end 134 of the secondary drain pipe 130. The pop up drain means includes an elbow 132 fluidically coupled to the second end 134 of the secondary drain pipe 130. A cover 144 is fixed to the opposite end of the elbow 132. A pop up, centrally located emitter or top 146 is movably captured within the cover 144 and is movable under hydrostatic pressure from a first position wherein the top 146 is disposed within or on the cover 144 closing an outlet or aperture in the cover 144 to a raised, open position shown in FIG. 5. In this open position, water flowing through the secondary drain pipe 130 from the container 110 may exit above surface grade level 72.

The discharge means 140 may also be mounted in a cavity filled with particulate material, such as stone or gravel.

In conclusion, there has been disclosed an improved building drainage system which uniquely allows cleanout of the bleeder lines located below the foundation floor, an exterior water collection and cleanout means, and a surface water collection and drainage system.

What is claimed is:

1. A drainage apparatus system for a building having a basement floor between walls supported on footings, the drainage apparatus comprising:

drain tile disposed about an outer perimeter of the footings to accumulate water adjacent the outer perimeter of the footings;

at least one bleeder conduit disposed beneath the basement floor and connected at a first end to the drain tile located exteriorly of the building and at a second end to a discharge pipe to direct water from the drain tile to the discharge pipe;

a hollow body having first and second ends and a flow passage extending between the first and second ends, the first and second ends fluidically interposed to the at least one bleeder line in a location spaced from the drain tile beneath and covered by the basement floor, the body having an upper portion with an openable end accessible through the basement floor, allowing a fluid stream to be injected into the hollow body through the openable end into the flow passage; and a one way valve disposed within the hollow body, the valve including a valve member movably mounted in the hollow body for fluid pressure responsive movement between a first position blocking fluid flow through the fluid passage in the hollow body in a first direction from the open end of the upper portion toward the first end of the hollow body and a second position allowing fluid flow from the first end and from the open end of the upper portion only toward the second end of the hollow body in a direction toward a sewer conduit to enable clean out of the bleeder line and the sewer conduit.

2. The drainage apparatus of claim 1 wherein the one-way valve means comprises:

a flapper member pivotally mounted within the body.

3. The drainage apparatus of claim 1 wherein:

the body is coupled to the at least one bleeder line adjacent to a building foundation wall.

4. The drainage apparatus of claim 1 further comprising:

a removable cap mountable on the openable end of the upper portion of the body.

5. A drainage apparatus for a building drain tile system fluidically connected to bleeder conduits below a foundation floor, the drainage apparatus comprising:

a hollow body fluidically interconnected to one bleeder line, the body having an upper portion accessible from the building floor;

one way valve means disposed within the body for allowing fluid flow through the body and the one bleeder line in one direction and for blocking fluid flow of a fluid stream injected through the upper portion of the body in a direction opposite from allowed fluid flow direction through the body;

a vertically extending interior conduit having first and second ends, the first end fluidically coupled to a building drain tile system, the second end accessible from above soil grade level, the interior conduit having side wall apertures allowing the ingress of water from an exterior of the interior conduit to the interior of the interior conduit;

an exterior conduit concentrically disposed about and spaced from the interior conduit;

the exterior conduit including a plurality of apertures allowing fluid flow from the exterior to the interior of the exterior conduit; and particulate material disposed between the interior conduit and the exterior conduit allowing fluid flow through the exterior conduit and the interior conduit to the building drain tile system.

6. The drainage apparatus of claim 5 further comprising:

removable cap means mounted on the second end of the interior pipe.

7. The drainage apparatus of claim 5 further comprising:

a first generally horizontally extending drainage member located below soil grade level and spaced from the foundation wall, the first drainage member including a plurality of apertures of water ingress to the interior of the first drainage member;

a second drainage member having first and second ends, the first end fluidically coupled to the first drainage member;

a reservoir means located below soil grade level for collecting water;

the second end of the second drain member fluidically coupled to the reservoir means; and means for discharging water collected in the reservoir means from the reservoir means.

8. The drainage apparatus of claim 7 wherein the discharging means comprises:

a plurality of apertures formed in walls of the reservoir means allowing water to dissipate exteriorly of the reservoir flow means.

9. The apparatus of claim 8 wherein the discharge means further comprises:

the reservoir means comprising a container disposed in a cavity below ground surface; and particulate material surrounding the container and filling the cavity.

10. The drainage apparatus of claim 8 wherein the discharge means further comprises:

a drain member fluidically coupled to and extending from the reservoir means, one end of the drain member being open for discharging water therefrom.

11. The drainage apparatus of claim 10 further comprising:

pop up discharge means coupled to the one end of the drain member and having a movable top positioned at soil grade level for discharging fluid from the drain member to soil grade level.

12. An exterior cleanout apparatus for a building drainage system incorporating drain tiles extending around a parameter of a building foundation, the exterior cleanout apparatus comprising:

a vertically extending interior conduit having first and second ends, the first end fluidically coupled to a building drain tile system, the second end accessible from above soil grade level, the interior conduit having side wall apertures allowing the ingress of water from an exterior of the interior conduit to the interior of the interior conduit;

an exterior conduit concentrically disposed about and spaced from the interior conduit;

the exterior conduit including a plurality of apertures allowing fluid flow from the exterior to the interior of the exterior conduit; and particulate material disposed between the interior conduit and the exterior conduit allowing fluid flow through the exterior conduit and the interior conduit to the building drain tile system.

13. The drainage apparatus of claim 12 further comprising:

removable cap means mounted on the second end of the interior pipe.

* * * * *